United States Patent [19]

Shimoma et al.

[11] Patent Number: 4,900,979

[45] Date of Patent: Feb. 13, 1990

[54] COLOR CATHODE RAY APPARATUS PROVIDED WITH DYNAMIC CONVERGENCE MEANS

[75] Inventors: Taketoshi Shimoma, Isesaki; Katsuei Morohashi, Menuma; Jiro Shimokobe, Fukaya, all of Japan

[73] Assignee: Kabushiki Kaisha Toshiba, Kawasaki, Japan

[21] Appl. No.: 198,822

[22] Filed: May 25, 1988

[30] Foreign Application Priority Data

May 28, 1987 [JP] Japan ..... 62-129620

[51] Int. Cl.[4] ..... H01J 29/51; H01J 29/56

[52] U.S. Cl. ..... 313/412; 313/428; 313/431; 313/437

[58] Field of Search ..... 313/412, 413, 428, 431, 313/437

[56] References Cited

U.S. PATENT DOCUMENTS 4,725,763 2/1988 Okuyama et al. ..... 313/412 X

FOREIGN PATENT DOCUMENTS 51-46573 12/1976 Japan .
53-1014 1/1978 Japan .
54-29227 9/1979 Japan .
61-265989 5/1985 Japan .
6243039 8/1985 Japan .
6243040 8/1985 Japan .

*Primary Examiner*—Kenneth Wieder
*Attorney, Agent, or Firm*—Cushman, Darby & Cushman

[57] ABSTRACT

In a color cathode ray apparatus, three electron beams emitted from electron gun assembly are correctly converged on a peripheral region of a peripheral region of a phosphor screen and are weakly converged on a center region of the phosphor screen by static convergence means. The electron beams are also converged by dynamic convergence means so as to correct the weak convergence in accordance with a horizontal deflection of the electron beams. Thus, the electron beams can be correctly converged all over the phosphor screen.

7 Claims, 11 Drawing Sheets

COLOR CATHODE RAY APPARATUS PROVIDED WITH DYNAMIC CONVERGENCE MEANS

BACKGROUND OF THE INVENTION

1. Field of the Invention

The present invention relates to a color cathode ray apparatus provided with an electron gun assembly of the in-line type and more particularly, a color cathode ray apparatus of the in-line type provided with a deflection unit.

2. Description of the Related Art

The color cathode ray apparatus of the in-line type has an envelope comprising a panel provided with a phosphor screen on which phosphor strips or dots for emitting three colors of red, green and blue are coated, a neck provided with an electron gun for emitting electron beams to the phosphor screen, and a funnel for connecting neck and the panel. The electron gun assembly of the in-line type for emitting three electron beams is housed in the neck. Arranged around the funnel are deflection magnetic fields generating unit for deflecting the electron beams in horizontal and vertical directions in such a manner that the phosphor screen is scanned with the electron beams emitted from the electron gun assembly. A shadow mask is so fixed to the panel as to face the phosphor screen and has a plurality of apertures, the electron beams passing through the aperture of the shadow mask and striking against the three-color phosphor strips or dots.

The deflection magnetic field generating units is so designed that horizontally deflecting magnetic field is of pin cushion shape, and that vertically deflecting magnetic field is of barrel shape. Thus, the three electron beams emitted from the electron gun assembly are converged upon the phosphor screen. This is called magnetic field of the self convergence type.

When the magnetic field is of the self convergence type like this, many advantages can be provided including that various kinds of terminals, convergence yokes and convergence circuit which are needed to adjust the convergence of beams are made unnecessary. However, the distortion of magnetic field is used to achieve the self convergence of beams, thereby causing the shape of electron beams to be distorted on the phosphor screen. FIG. 1A shows the spot shape of an electron beam deflected at an end region on the horizontal axis of the phosphor screen, said beam being distorted having bright core portion 22 longer in the horizontal direction and dark halo portion 23 longer in the vertical direction. FIG. 1B shows the spot shape of an electron beam deflected at an end region on the vertical axis of the phosphor screen, said beam being distorted having small and bright core portion 22 longer in the vertical direction and large and dark halo portion 23 longer in the vertical direction.

In the case of the color cathode ray apparatus of the in-line type, the spot shape of deflected beams is distorted, as described above, which causes the resolution of the color cathode ray tube to be deteriorated.

SUMMARY OF THE INVENTION

The object of the present invention is to provide a color cathode ray apparatus of the in-line type capable of reducing the distortion of deflected electron beams and enhancing its resolution.

According to the present invention there is provided a color cathode ray apparatus comprising:

a vacuum envelope having a horizontal axis and a vertical axis crossing the horizontal axis;

a phosphor screen formed in the envelope;

an electron gun assembly of the in-line type for emitting center and side electron beams to the phosphor screen;

a shadow mask provided with a plurality of apertures and faced to the phosphor screen to allow three electron beams to pass therethrough toward the phosphor screen;

deflecting means arranged outside the envelope to deflect the electron beams in horizontal and vertical directions, that magnetic field which deflects the electron beams in the horizontal direction being of the barrel type;

a static convergence means for converging the three electron beams, said static convergence means correctly converging the three electron beams on the peripheral region of the phosphor screen on the horizontal axis thereof and allowing the three electron beams directed to the center region of the phosphor screen to have a weak convergence; and a dynamic convergence means for further converging the electron beams having weak convergence to correct the weak convergence in accordance with the horizontal deflection, so that the electron beams can be correctly converged all over the phosphor screen by the deflecting means, the static convergence means and the dynamic convergence means.

DETAILED DESCRIPTION OF THE PREFERRED EMBODIMENTS

The fundamental concept of the present invention will be explained with reference to FIGS. 2 through 5, prior to describing an example of the color cathode ray apparatus according to the present invention.

Figure 1A:
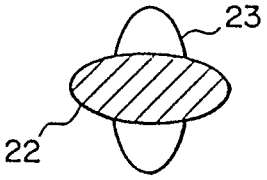
FIG. 1A (PRIOR ART)
FIGS. 1A and 1B are plan views showing shapes of beam spots formed on the phosphor screen of the conventional cathode ray apparatus.
Figure 1B:
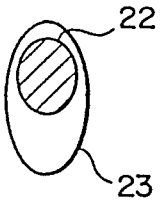
FIG. 1B (PRIOR ART)
Figure 2:
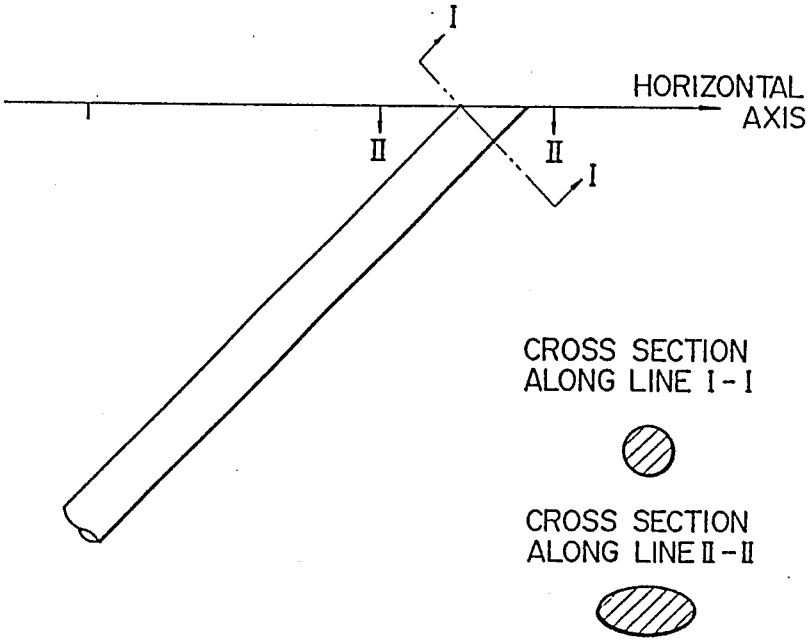
FIG. 2 shows how the electron beam is landed on the phosphor screen when it is deflected in the horizontal direction and FIG. 2 also shows the section of this electron beam and the spot shape thereof landed on the phosphor screen.

Even if an electron beam emitted from the electron gun of the color cathode ray tube is circular in section, the spot shape of this beam is made longer in the horizontal direction when this beam is deflected and struck against an end region of the phosphor screen on the horizontal axis thereof, because the electron beam comes into the phosphor screen under the state that it is slanted relative to the phosphor screen, as shown in FIG. 2. It is therefore preferable that the electron beam emitted from the electron gun is previously made longer in section in the vertical direction.

Figure 3A:
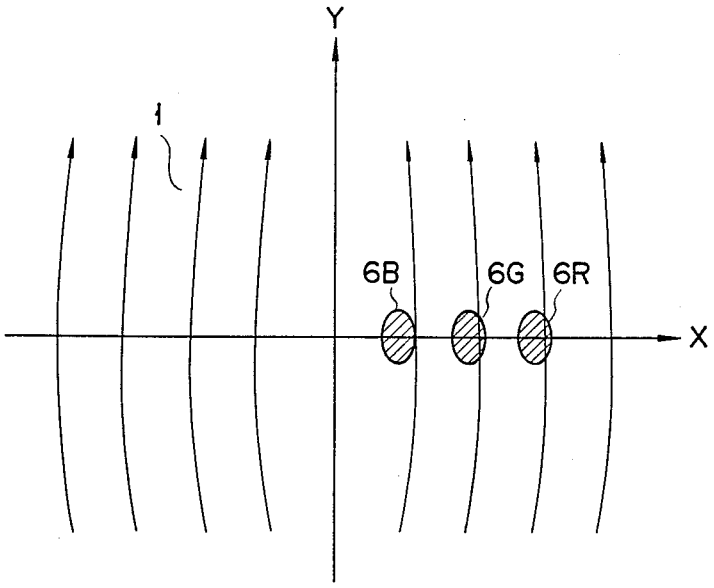
FIGS. 3A and 3B are plan views showing the horizontally deflecting magnetic field of the barrel type and also showing a relation between this magnetic field and those forces which are exerted to the electron beams through the magnetic field.
Figure 3B:
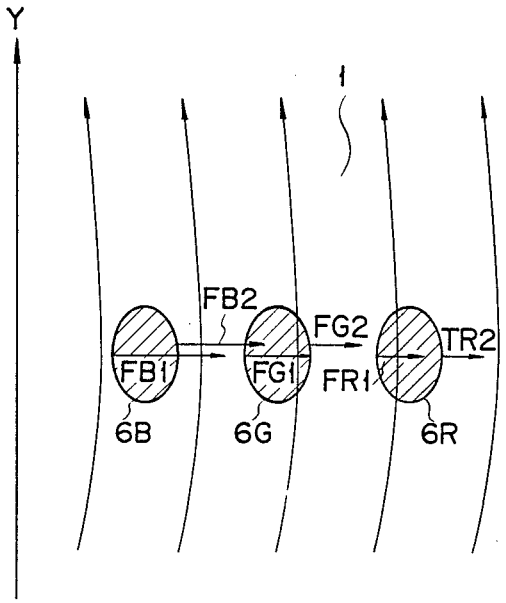

In the case of a cathode ray apparatus according to the present invention, therefore, horizontally deflecting magnetic field is formed like a barrel, as shown in FIG. 3A and the electron beams are deformed longer in section in the vertical direction by this magnetic field. When the electron beams enter into the horizontally deflecting magnetic field of the barrel type, forces are applied to the electron beams passing through the magnetic field, as shown in FIG. 3B. It is assumed in FIG. 3B that force exerted to the left end of the section of electron beam 6B which is intended to land on the blue phosphor stripes or dots is represented by FB1 and force exerted to the right end thereof by FB2, that force exerted to the left end of the section of electron beam 6G which is intended to land on the green phosphor stripes or dots is denoted by FG1 and force exerted to the right end thereof by FG2, and that force exerted to the left end of the section of electron beam 6R which is intended to land on the red phosphor stripes or dots is denoted by FRI and force exerted to the right end thereof by FR2. The intensity of the magnetic field becomes smaller and smaller in the case of the barrel-shaped magnetic field as it departs from the center of magnetic field. The relation of these forces exerted to the three electron beams, therefore, is FB1>FB2>FG1>FG2>FR1>FR2. Namely, the forces exerted to three electron beams 6R, 6G, 6B become stronger and stronger as it comes nearer to the center of the horizontally deflecting magnetic field, so that each of the electron beams can be deformed longer in section in the vertical direction by this barrel-shaped magnetic field.

The shape of the electron beams can be improved, as described above, by employing the horizontally deflecting magnetic field of the barrel type, but the convergence of these three electron beams cannot be achieved if they are left as deflected by the magnetic field. Therefore, the present invention employs the following means to obtained the good convergence of the three electron beams.

Employed by the electron gun assembly of the color cathode ray apparatus according to the present invention is the well-known static convergence means, for example, intended to shift the openings of electrodes opposite to the main lens from one another or to previously arrange the electrodes to slant the passages of electron beams, thereby enabling the three electron beams to be statically converged. The static convergence means and the deflecting magnetic field generating means are designed in such manners that three electron beams 6R, 6G, 6B have a weak convergence in and around the center region of the phosphor screen, as shown in FIG. 4A, when the electron beams are not deflected and that three electron beams 6R, 6G, 6B are correctly converged, as shown in FIG. 4B, when the deflecting magnetic field generator means is rendered operative in addition to the static convergence means to deflect the electron beams to the end region of the phosphor screen on the horizontal axis thereof.

The present invention further employs a dynamic convergence means in addition to the above-described static convergence means and deflecting magnetic field generating means. The dynamic convergence means is made operative to correct the weak convergence in and around the center region of the phosphor screen, thereby enabling three electron beams 6R, 6G, 6B to be converged all over the phosphor screen, as shown in FIG. 4B.

Figure 5:
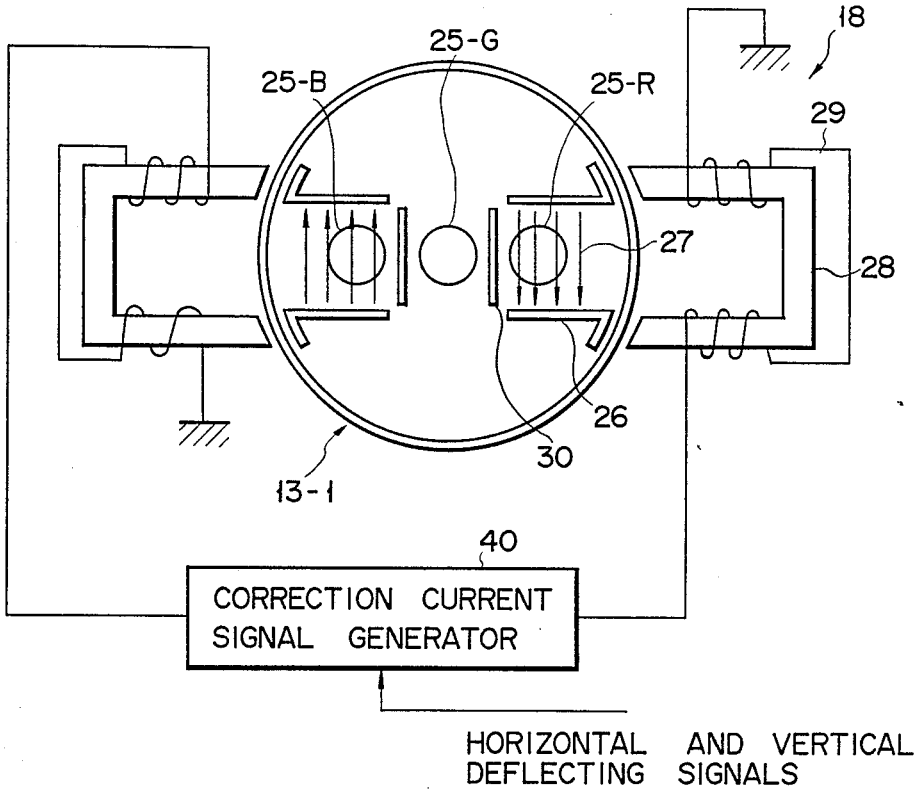
FIG. 5 is a plan view showing an arrangement of the dynamic convergence means.

It is well known that the dynamic convergence means is used to converge the three electron beams, and FIG. 5 shows an example of the dynamic convergence means. This dynamic convergence means includes two pairs of magnetic field forming members 26 made of magnetic material and oppose parallel to each other. Each of both side beams of the three electron beams emitted from the electron gun passes through each of side beam paths which is defined between each pair of magnetic members 26. The dynamic convergence means further includes correction magnetic field generating units 28 located adjacent to the paired magnetic field forming members 26 to magnetically coupled to them and to generate correcting magnetic field between the opposed magnetic field forming members, wherein first pair of the magnetic field forming members form correcting magnetic field 27 directed in a direction reverse to that of correcting magnetic field formed between the other pair of the magnetic field forming members. This dynamic convergence means is usually located adjacent to the front end of the electron gun.

Figure 4A:
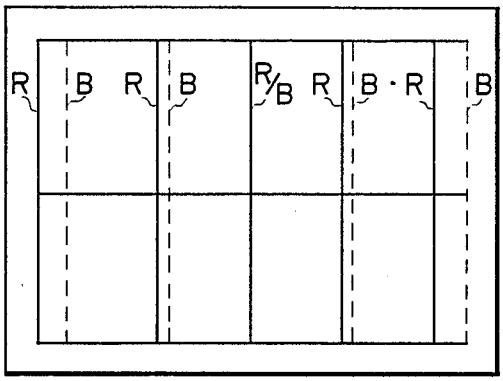
FIGS. 4A, 4B and 4C are plan views showing those various states under which the electron beams are converged.
Figure 4B:
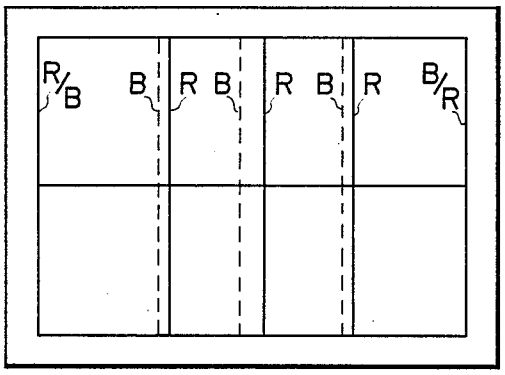
Figure 4C:
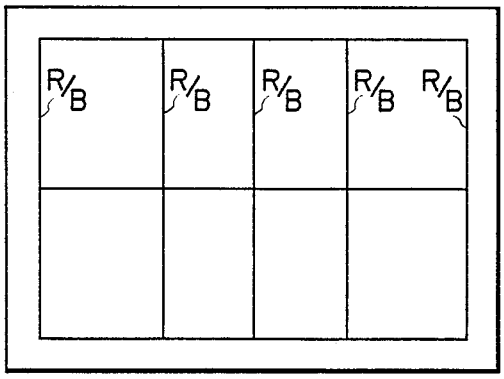

The conventional static convergence means is so designed that the three electron beams are converged in and around the center of the phosphor screen and that they are overconverged at the end region of the phosphor screen on the horizontal axis thereof, as shown in FIG. 4A. In order to make the dynamic convergence means operative to cancel the overconvergence under this state, it is necessary that such a such correcting magnetic field is so formed in those paths through which the side beams pass as to widen the distance between both side electron beams 6R and 6G. As the result, the convergence can be improved but force acts on each of the side beams to make it longer in section in the horizontal direction, thereby making it impossible to obtain an ideal spot shape of each of the beams at the end region of the phosphor screen on the horizontal axis thereof.

Further, in the case of the dynamic convergence means, correcting magnetic field 27 is superposed by magnetic field leaked from the deflecting magnetic field generator means or deflecting yokes to damage the uniformity of correcting magnetic field 27, thereby causing the spot shape of each of the beams to be disturbed. The dynamic convergence means is located adjacent to the front end of the electron gun, as describe above. Even when correcting magnetic field 27 having an ideal distribution is formed, therefore, the magnetic field leaked from the deflecting magnetic field generator means reaches to the dynamic convergence means. As the result, correcting magnetic field 27 is superposed by the leaked magnetic field, thereby causing correcting magnetic field 27 to be acceptably disturbed.

On the contrast, the three electron beams are converged at the end region of the phosphor screen on the horizontal axis thereof in the case of the present invention and no correcting magnetic field is thus applied to the electron beams, which are directed to the end region of the phosphor screen on the horizontal axis thereof, by means of the dynamic convergence means. Even when the magnetic field leaked from the deflecting magnetic field generating means reaches the dynamic convergence means, therefore, the spot shape of each of the electron beams is not disturbed at the end region of the phosphor screen on the horizontal axis thereof.

The three electron beams are weakly converged on and around the center of the phosphor screen by the static convergence means. Therefore, the present invention uses the dynamic convergence means to correct this weak convergence in such a way that correcting magnetic field 27 is formed by the dynamic convergence means to narrow the interval between both side electron beams 6R and 6G. As the result, force acts on each of the electron beams to make it longer in section in the vertical direction, thereby enabling the electron beams to be good in spot shape on the phosphor screen.

In the case of the color cathode ray apparatus according to the present invention, therefore, no distortion of the electron beams is caused and the convergence of the three electron beams is made better all over the phosphor screen by the above-described interactions.

Figure 11:
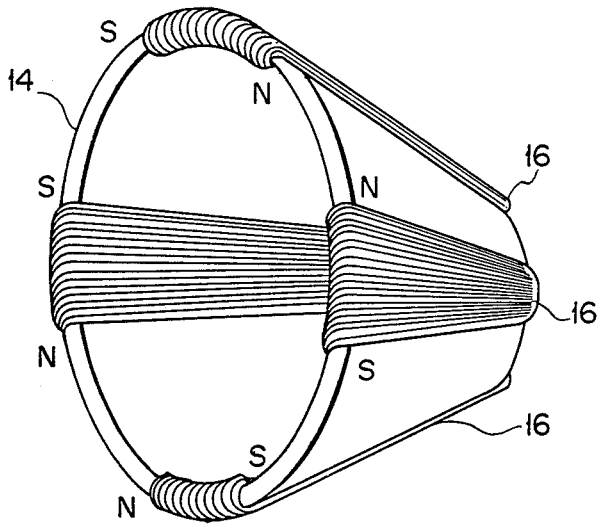
FIGS. 11 and 12 are perspective views showing other correction magnetic field forming coils of the dynamic convergence means.
Figure 12:
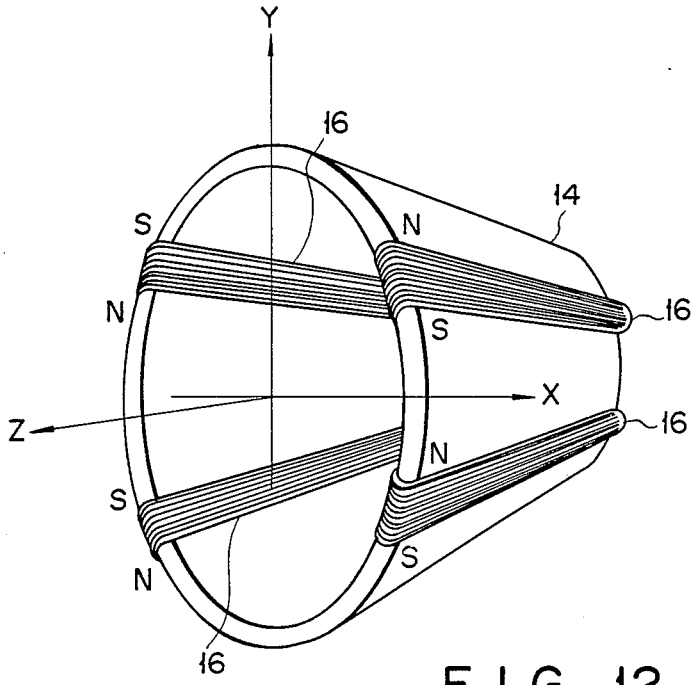
Figure 13A:
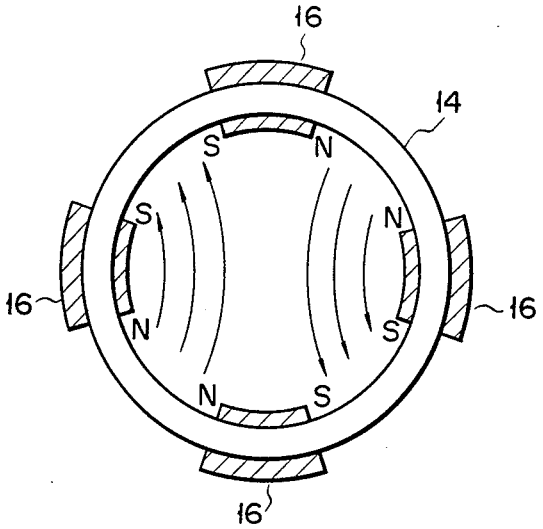
FIGS. 13A and 13B show those magnetic fields which are formed in the tube by the correction magnetic field forming coils shown in FIGS. 11 and 12.
Figure 13B:
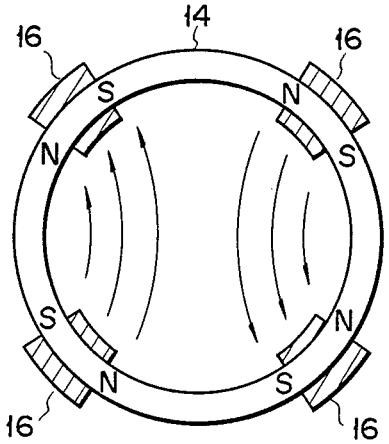

The dynamic convergence means can be realized by those coils which are formed as shown in FIGS. 11 and 12, in addition to the one shown in FIG. 5. It may be arranged that one of these coils shown in FIGS. 11 and 12 is located adjacent to the deflecting magnetic field generating means to generate such four-pole magnetic field as shown in FIGS. 13A and 13B. Same effects as the above-mentioned ones can be achieved in this case, too.

An embodiment of the color cathode ray apparatus according to the present invention will be described with reference to FIGS. 4 through 15B.

Figure 6:
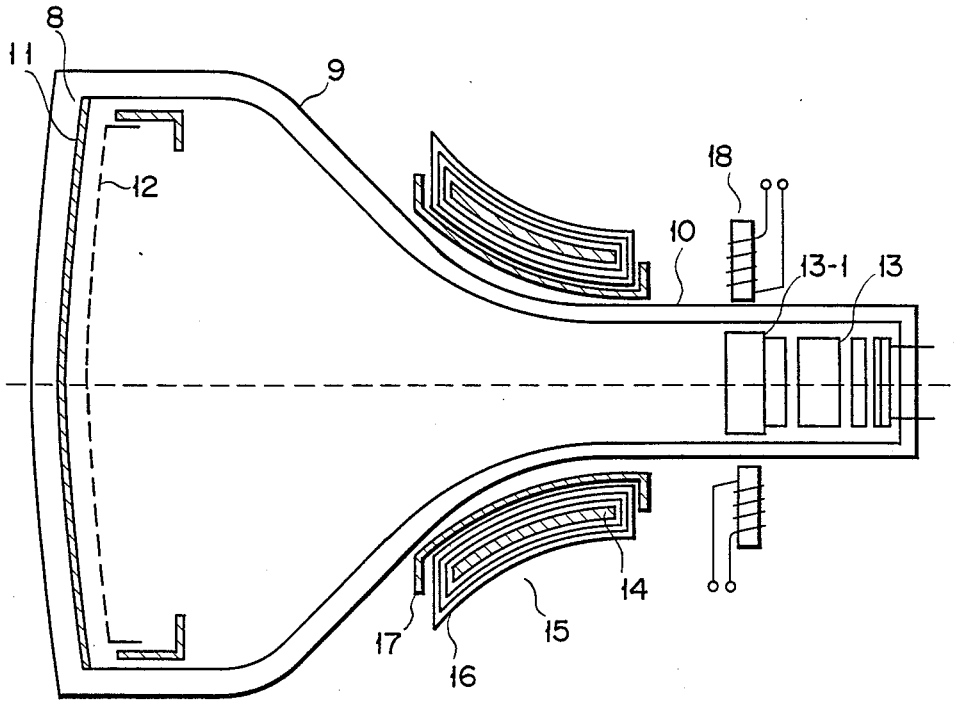
FIG. 6 is a sectional view showing an example of the cathode ray apparatus according to the present invention.

FIG. 6 is a sectional view showing an example of the color cathode ray apparatus according to the present invention. An envelope is formed by panel 8, funnel 9 and neck 10, and phosphor screen 11 is formed by coating stripe- or dot-like phosphor on the inner face of panel 8. Electron gun 13 of the in-line type for emitting three or center and side electron beams to phosphor screen 11 is housed in neck 10. The electron beams are deflected by deflection means 15 located outside the funnel to generate deflecting magnetic field, and the beams thus deflected are then landed on phosphor screen 11.

Figure 7:
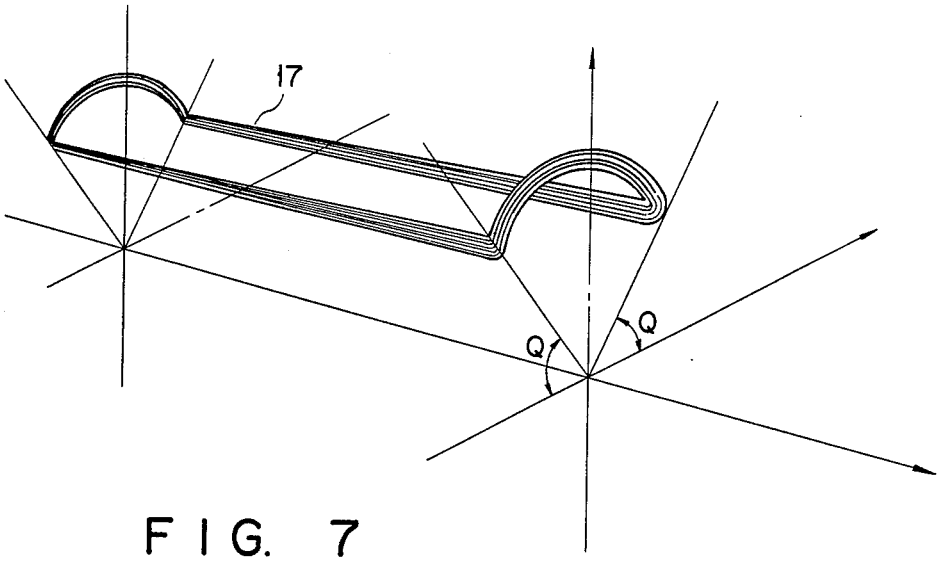
FIG. 7 is a perspective view showing an example of the horizontally deflecting coil shown in FIG. 6 and intended to form the horizontally deflecting magnetic field of the barrel type.

Deflecting magnetic field generator means 15 comprises vertically deflecting coil 16 for forming barrel-shaped magnetic field and horizontally deflecting coil 17 for forming barrel-shaped magnetic field. Vertically deflecting coil 16 is wound around ferrite core 14. When horizontally deflecting coil 17 for forming barrel-shaped magnetic field is to be formed like a saddle, the winding angle of the saddle coil may be set $\theta > 30°$, as shown in FIG. 7. Vertically and horizontally deflecting coils 16 and 17 are separated from each other by a separator (not shown).

Shadow mask 12 is so fixed to panel as to face to phosphor screen 11, as shown in FIG. 6, and the three electron beams passed through an aperture of shadow mask 12 are landed on phosphor screen 11 and phosphor screen 11 is scanned with the electron beams.

Figure 8:
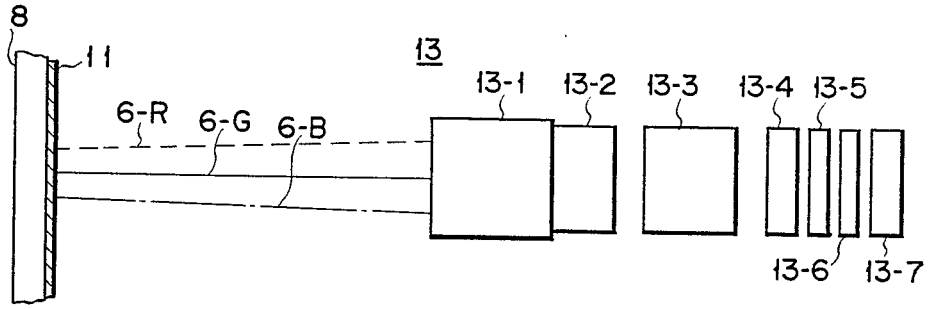
FIG. 8 is a side view showing an electron gun assembly provided with the static convergence means in FIG. 6.
Figure 9:
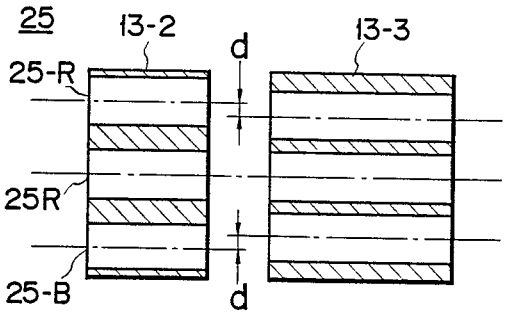
FIG. 9 is a sectional view showing an arrangement of the static convergence means in FIG. 8.

Electron gun 13 of an electron gun assembly include a plurality of electrodes 13-1 to 13-7 arranged side by side on the horizontal axis, as shown in FIG. 8, and three electron beams 6R, 6G and 6B are emitted from electron gun 13. In the electron gun assembly, static convergence is adjusted in such manners that three electron beams 6R, 6G and 6B are weakly converged on and around the center of phosphor screen 11 when no deflecting magnetic field acts on the beams or when the beams are not deflected, and that three electron beams 6R, 6G and 6B are correctly converged on the end region of phosphor screen 11 on the horizontal axis thereof when deflecting magnetic field acts on the beams to direct them to the end region of phosphor screen 11 on the horizontal axis thereof. The openings of final electrode 13-2 and those of converging electrode 13-3 of electron gun 13 through which the electron beams pass are thus shifted from one another, as shown in FIG. 9. More specifically, centers of openings 25R and 25B of final electrode 13-2 through which both side electron beams pass are shifted outward by distance (d), respectively, from those of openings of converging electrode 13-3 through which both side electron beams pass. According to this static convergence means, the convergence of the three electron beams depends upon eccentric amount (d). Therefore, this eccentric amount (d) may be selected, depending upon the extent of convergence lack.

Dynamic convergence means 18 for correcting the weak convergence of the three electron beams are located adjacent to convergence cup 13-1 at the front end of the final electrode of electron gun 13, as shown in FIG. 6.

This dynamic convergence means has the same arrangement as that of the conventional means, as shown in FIG. 5.

Dynamic convergence means 18 includes a pair of magnetic field forming members 26 made of permalloy and arranged inside convergence cup 13-1, and correction magnetic field generating units 28 made of ferrite and located outside neck 10.

Paired magnetic field forming members 26 are made of magnetic material and opposed parallel to each other on a horizontal plane. Each of the side electron beams emitted from the electron gun pass through each of side beam paths defined between each pair of members 26. Correcting magnetic field generating units 28 are located outside neck 10, but its one ends are positioned adjacent to paired magnetic field forming members 26 to magnetically couple to them.

Coil 29 is wound around each of correcting magnetic field generating units 28 which correspond to the both side electron beams and magnetic flux which is generated in magnetic field generating unit 28 by current applied to the coil flows to magnetic field forming members 26 to form correcting magnetic field 27 between magnetic field forming members 26. The direction of the current applied to coils 29 is selected in such a way that the direction of correcting magnetic field 27 formed between one paired magnetic field forming members 26 is reverse to that of correcting magnetic field 27 formed between the other paired magnetic field forming members 26.

Figure 10A:
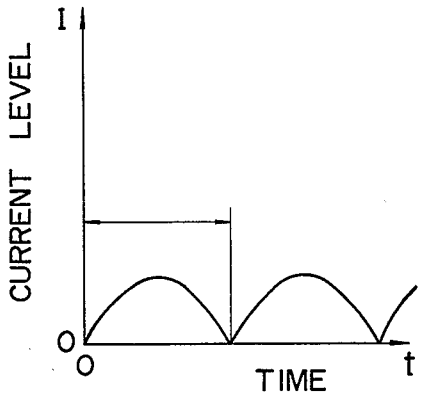
FIGS. 10A, 10B and 10C show waveforms of correction current signals generated by a correction current signal generator of the dynamic convergence means shown in FIG. 5.
Figure 10B:
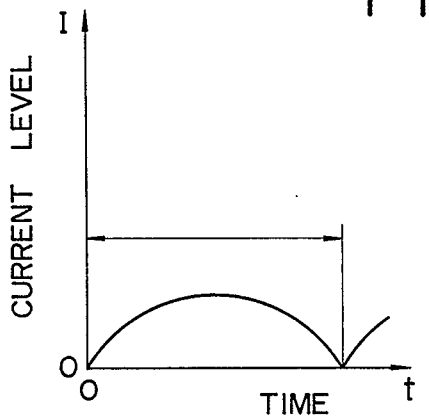
Figure 10C:
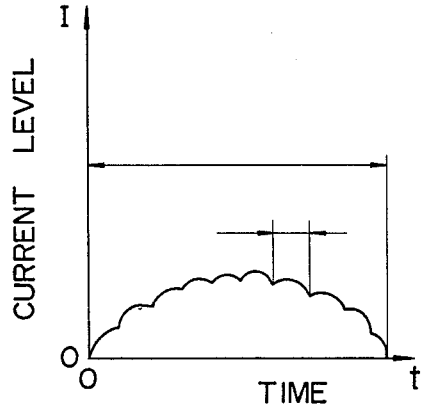

Correction current signals are supplied from generator 40 to dynamic convergence means 18. Drive current which is supplied to vertically and horizontally deflecting coils 16 and 17 is similarly supplied to this generator 40, which applies correction voltage to terminals of coils 29, synchronizing with this drive current supplied. Current synchronous with horizontal deflecting signal as shown in FIG. 10A and parabolic current synchronous with vertical deflection signal as shown in FIG. 10B are supplied to each of coils 29. Needless to say, such current as shown in FIG. 10C and that is a result of combining those shown in FIGS. 10A and 10B may be supplied.

Magnetism shielding plates 30 are arranged on both sides of passage 25G through which the center electron beam passes to leave the center electron beam not influenced by correcting magnetic field 27 when dynamic convergence means 18 are made operative to generate correcting magnetic field 27.

When the color cathode ray apparatus having the above-described arrangement is operated, three electron beams 6R, 6G and 6B emitted from electron gun 13 to phosphor screen 11 are deflected in the vertical and horizontal directions by deflecting magnetic field formed by vertically and horizontally deflecting coils 16 and 17, and their paths are corrected by dynamic convergence means 18 as well, so that more good images can be reproduced on the phosphor screen.

In order to form correcting magnetic field not using the arrangement shown in FIG. 5, it may be arranged that auxiliary coil 16 is wound around ferrite core 14 as shown in FIG. 11 or 12, that coil-wound ferrite 14 is located beside the horizontally deflecting coil, and that current shown in FIG. 10A or 10B is supplied to coil 16. Such magnetic field as shown in FIG. 13A or 13B superposes upon deflecting magnetic field in this case and deflection and convergence of the three electron beams are substantially carried out at the same time.

Figure 14:
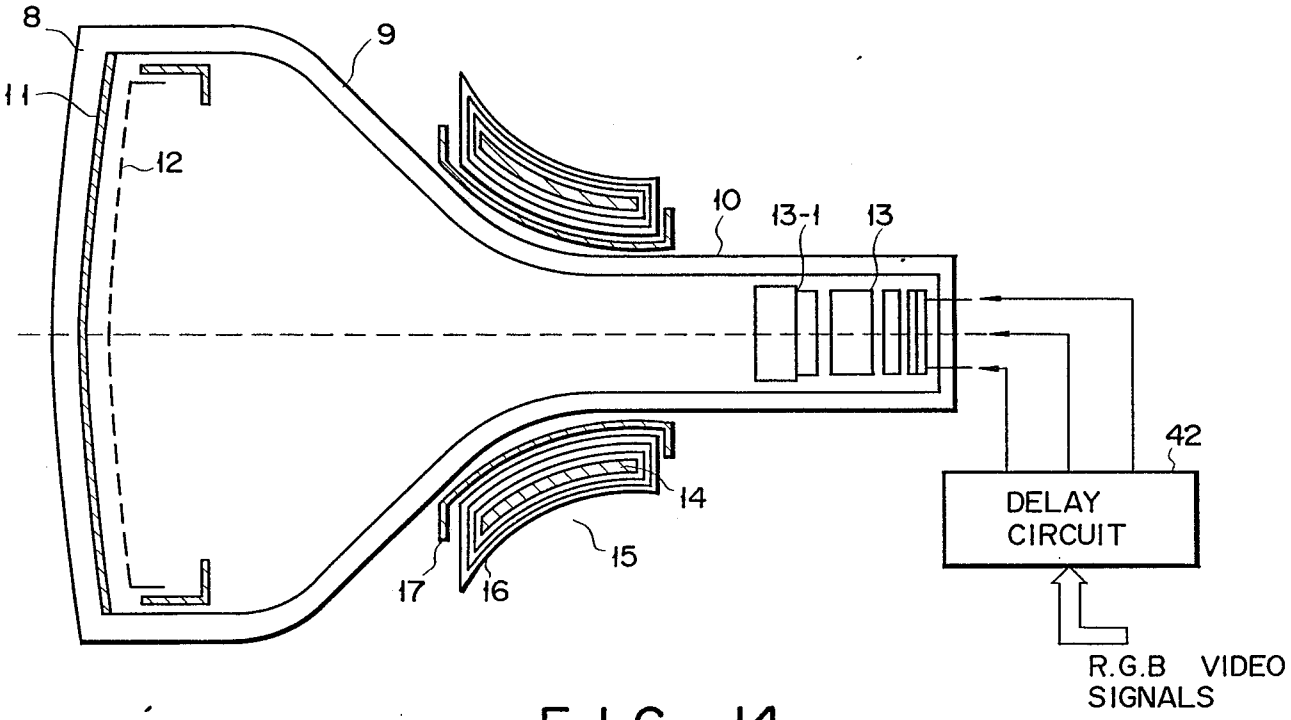
FIG. 14 is a sectional view showing another example of the cathode ray apparatus according to the present invention.

Although the dynamic convergence means has controlled magnetic field in the above-described embodiments of the present invention, it may be arranged that video signals of three colors R, G and B applied to the electron gun assembly are delayed one another by delay circuit 42 shown in FIG. 14. This delay of video signals will be described below.

In order to correct the convergence shifts of the three electron beams, such delays that correspond to these convergence shifts are applied to the video signals. However, effect differs to a great extent depending upon whether these delays of the video signals are carried out when the electron beams are directed to the center region of the phosphor screen or when they are directed to the peripheral region of the phosphor screen.

In a case where the video signal delays are carried out when the electron beams are directed to the peripheral region of the phosphor screen or where the three electron beams are not converged at the peripheral region of the phosphor screen, the width of image area becomes narrow, as shown in FIG. 4A, corresponding to the convergence shifts. As shown in FIG. 4A, the electron beam which corresponds to Blue area B is landed more inward than the beam which corresponds to Red area R at the left end of the phosphor screen, and the left side of the width of the video region is determined at the position of Blue area B. The width (or angle) of deflecting the electron beams must be therefore increased to compensate the width of the image areas. Current consumption is thus increased because of the increase of deflecting current applied to the deflecting coils. In addition, the insulation ability of the coils is reduced because of the increase of heat applied to the deflecting coils.

In another case where the video signal delays are carried out when the electron beams are directed to the center of the phosphor screen or where the convergence of the three electron beams is shifted not at the peripheral region of the phosphor screen but in the center thereof, the width of the image area is not made narrow and it is therefore unnecessary to increase current applied to the deflecting coils. This is quite advantageous.

Figure 15B:
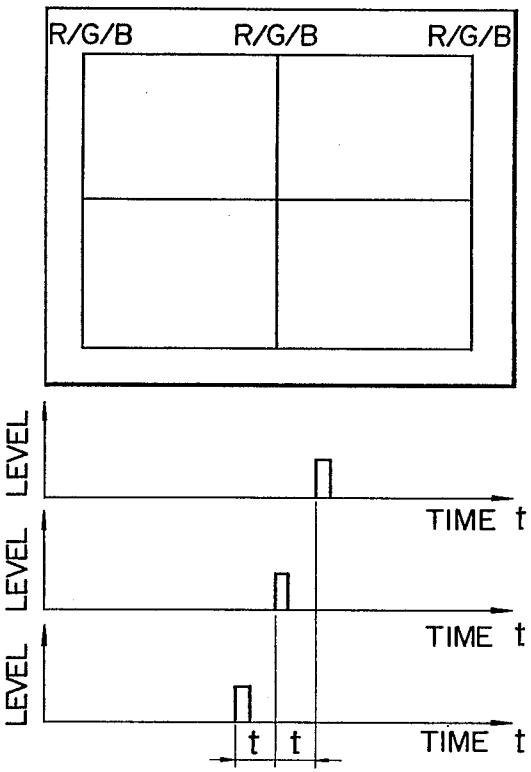
FIGS. 15A and 15B show waveforms of video signals obtained when the video signals are delayed and when they are not delayed and these Figures also include plan views showing how the electron beams are converged on the phosphor screen in these cases.
Figure 15A:
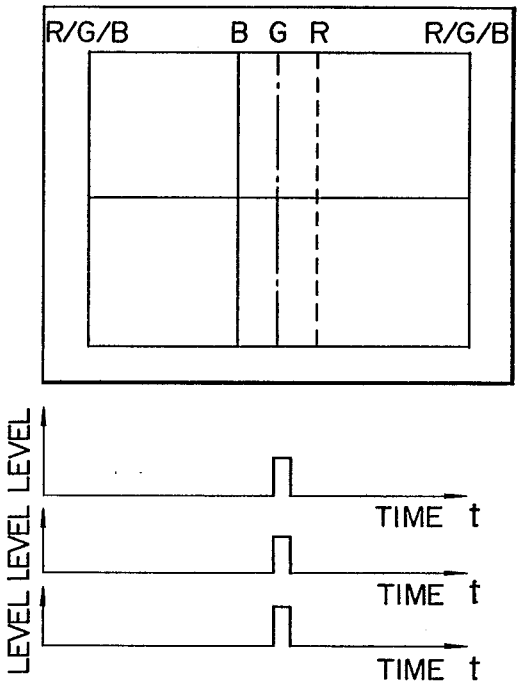

According to the present invention, the video signals are delayed at the time when the electron beams are forwarded to the center of the phosphor screen, thereby providing the above-mentioned advantages. FIG. 15A shows the video signals and how the convergences of the electron beams are shifted from one another when no delay is applied, while FIG. 15B shows the video signals and how the convergences of the electron beams are shifted from one another when the delays are applied. As apparent from the comparison of these two cases, the electron beams can be more correctly converged when the video signals are delayed.

The manner of delaying the video signals is well known. It is preferable to use CCD, BBD or the like as the delay element so as to control delay time, synchronizing with horizontally and vertically deflecting signals, for example.

Although the static convergence means has served to shift the electron beam passages of an electrode opposite to the main lens from those of another electrode also opposite to the main lens in the abovedescribed embodiments of the present invention, it may be arranged that the electrodes are previously arranged to slant the passages of the electron beams.

According to the present invention as described above, there can be provided a color cathode ray apparatus capable of reducing the distortion of the deflected electron beams and enhancing its resolution.

What is claimed is:

1. A color cathode ray apparatus comprising:

a vacuum envelope;

a phosphor screen formed in the envelope which includes a center region, horizontal side regions each arranged on either horizontal side of the center region, and vertical side regions each arranged on either vertical side of the center region;

an electron gun assembly of the in-line type for emitting center and side electron beams to the phosphor screen;

a shadow mask provided with a plurality of apertures and facing the phosphor screen to allow three electron beams to pass therethrough toward the phosphor screen;

deflecting means arranged outside the envelope for generating vertical and horizontal magnetic fields to deflect the electron beams in horizontal and vertical directions, the horizontal magnetic field being of the barrel type;

a static convergence means for correctly converging the three electron beams being applied to the horizontal side regions of the screen and allowing the three electron beams directed to the center region of the phosphor screen to have a weak convergence compared to the convergence of the beams applied to the horizontal side regions; and a dynamic convergence means for further converging the electron beams having weak convergence and being applied to the center region of the screen to correct the weak convergence in accordance with the horizontal deflection, so that the deflected electron beams are correctly converged all over the phosphor screen.

2. The color cathode ray apparatus according to claim 1, wherein said dynamic convergence means includes two pairs of magnetic plates, the magnetic plates of each pair being arranged, parallel to each other, along the horizontal axis, defining a gap therebetween, and means for generating correcting magnetic field in each of the gaps between the magnetic plates, said side electron beams emitted from the electron gun assembly pass through corresponding gaps between the magnetic plates, and magnetic field formed in the one gap between the paired magnetic plates is directed in a direction reverse to that of magnetic field formed in the other gap between the other paired magnetic plates.

3. The color cathode ray apparatus according to claim 2, wherein said dynamic convergence means is located adjacent to the electron gun assembly and said means for generating correcting magnetic field includes electromagnetic units located outside the envelope to supply magnetic flux to the magnetic plates and a means for generating signals to energize the electromagnetic units, depending upon the convergence of the electron beams.

4. The color cathode ray apparatus according to claim 1, wherein said dynamic convergence means includes magnetic field generating units for applying correcting magnetic field to the side electron beams, which are directed from the electron gun assembly to the phosphor screen, depending upon the convergence of the electron beams.

5. The color cathode ray apparatus according to claim 4, wherein said magnetic field generating units are located together with the deflecting means outside the envelope.

6. The color cathode ray apparatus according to claim 1, further comprising means for generating three video signals to be supplied to said electron gun assembly, said center and side electron beams being generated from said electron gun assembly in accordance with said three video signals.

7. The color cathode ray apparatus according to claim 6, wherein said dynamic convergence means includes a means for delaying said three video signals, depending upon the convergence of the electron beams.

* * * * *